United States Patent [19]

Nelson

[11] 4,417,463

[45] Nov. 29, 1983

[54] RAM ASSEMBLY FOR ELECTROMAGNETIC RIVETER

[75] Inventor: Paul E. Nelson, Tacoma, Wash.

[73] Assignee: The Boeing Company, Seattle, Wash.

[21] Appl. No.: 305,817

[22] Filed: Sep. 28, 1981

[51] Int. Cl.[3] ..... B21J 7/30; B21J 15/24

[52] U.S. Cl. ..... 72/430; 29/243.54

[58] Field of Search ..... 72/430, 56, 391; 29/421 M, 243.53, 243.54, 243.52; 173/117

[56] References Cited

U.S. PATENT DOCUMENTS

| | | | |
|---|---|---|---|
| 3,584,496 | 6/1971 | Keller | 72/430 |
| 3,704,506 | 12/1972 | Orr | 29/243.54 |
| 3,811,313 | 5/1974 | Schut | 72/430 |
| 4,128,000 | 12/1978 | Hogenhout | 72/430 |
| 4,132,108 | 1/1979 | Hogenhout | 72/430 |

*Primary Examiner*—Gene P. Crosby

*Attorney, Agent, or Firm*—Conrad O. Gardner; B. A. Donahue; Nicolaas DeVogel

[57] ABSTRACT

A ram assembly for an electromagnetic work tool which includes a ram shaft, conductive driving plate, and insulator plug, which elements are bonded together to form an integral ram assembly thereby reducing shear stress on the insulator plug since no counterbores or screws are utilized in the ram assembly. The insulator plug utilizes a composite of unidirectional glass fibers in an epoxy matrix, which glass fibers are oriented parallel to the axis of the ram shaft thereby providing superior load distribution of the insulator plug. A reduced number of interfaces in the ram assembly provides less interfaces for reflection of shock waves.

1 Claim, 2 Drawing Figures

RAM ASSEMBLY FOR ELECTROMAGNETIC RIVETER

This invention relates to electromagnetic high energy impact apparatus and more particularly to a novel ram assembly for electromagnetic riveting guns such as shown in U.S. Pat. Nos. 3,811,313 and 4,128,000, also assigned to The Boeing Company.

Figure 1:
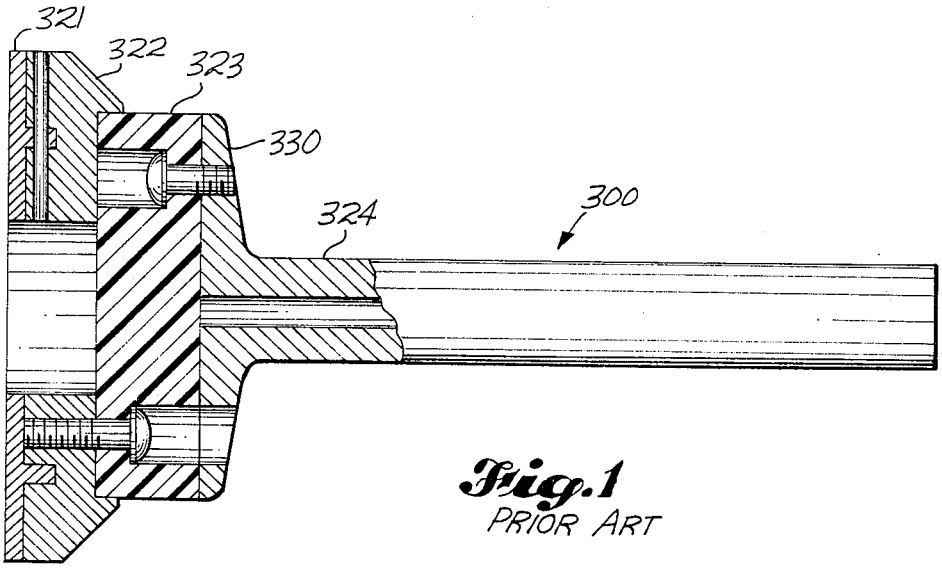
Fig. 1 PRIOR ART

Prior art electromagnetic riveting guns such as shown in U.S. Pat. No. 3,811,313 to Schut, have utilized a solid ram shaft configuration in the ram assembly of the electromagnetic riveting gun. FIG. 1 of U.S. Pat. No. 4,128,000, which is illustrative of the prior art as shown in U.S. Pat. No. 3,811,313, also utilized adhesives in the assembly thereof as noted in the description of U.S. Pat. No. 4,128,000.

The ram assembly shown in U.S. Pat. No. 4,128,000 to Hogenhout et al. shows a ram assembly comprising a ram shaft, conductive driving plate, driving disc, and insulator plug which are mechanically fastened together with 18 screws, washers, and roll pins. Such an assembly requires close tolerances in the construction of the aforementioned four parts, with any looseness causing early failure. Further, there is very little shear strength under the screw heads of such prior art ram assembly.

It is accordingly an object of this invention to provide an improved work center in an electromagnetic work tool which includes a three-part ram assembly of integral structural configuration.

It is yet another object of this invention to provide insulator plug means in a ram assembly for use in an electromagnetic riveter system, which insulator plug means includes a unidirectional glass fiber epoxy matrix wherein the glass fibers are oriented to provide reduction in shear stress in the insulator plug means.

It is still a further object of the present invention to provide a ram assembly having a hollow ram shaft, a glass epoxy composite insulator plug, and a conductive driving plate bonded together with a thermo-set epoxy adhesive to form an integral structure.

Figure 2:
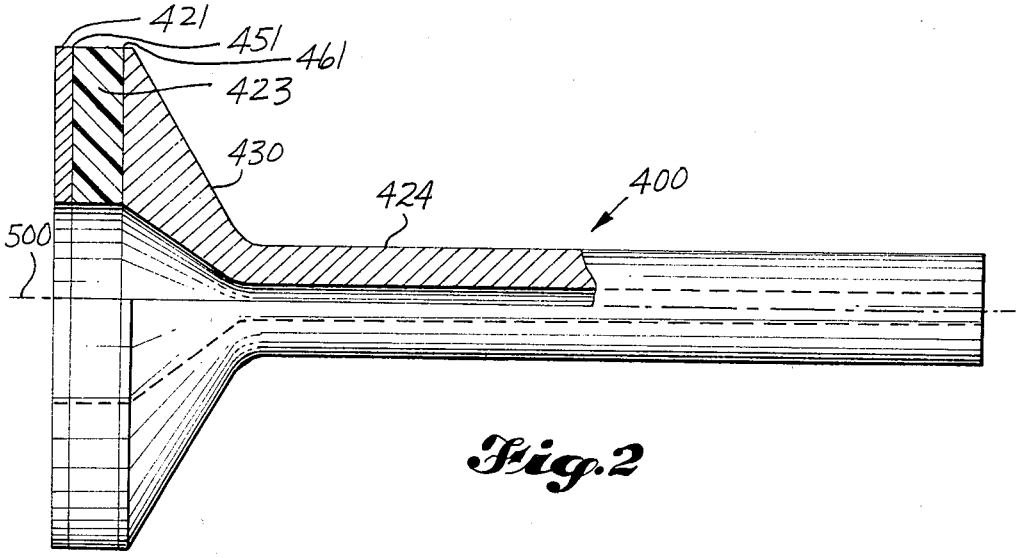

The above and further objects, features, and advantages of the present invention will become more clearly apparent from the following detailed description thereof which is to be read in conjunction with the drawings in which:

FIG. 1 is representative of the prior art ram assembly shown in FIG. 3 of U.S. Pat. No. 4,128,000; and, FIG. 2 is an integral ram assembly structure in accordance with a preferred embodiment of the present invention.

Turning now to FIG. 1 which shows the prior art ram assembly also shown in FIG. 3 of U.S. Pat. No. 4,128,000, it can be seen that such prior art ram assembly includes a conductive driving plate 321, an aluminum driving disc 322, a cylinder-like insulator plug 323 and a tubular-shaped ram shaft 324 which includes a flange-like end portion 330. It can be further noted from the description of U.S. Pat. No. 4,128,000 that the aforementioned four parts are mechanically fastened together with 18 screws, washers, and roll pins. The assembly must be made to close tolerances because any looseness will cause early failure. The ram assembly 300 shown in FIG. 1 is a key component of the electromagnetic riveter system shown and described in detail in remaining portions of the description of U.S. Pat. No. 4,128,000. It is known in the prior art that the capacitor bank of the electromagnetic riveter discharges a high amperage pulse of current through a magnetic coil. The intense magnetic field reacts with conductive driving plate 321 which comprises a copper ring on ram assembly 300 to propel it away from the coil. The mechanical impulse is delivered to the rivet as the ram assembly moves forward at very high speed. The ram assembly travels approximately 0.2 inches as it upsets a $\frac{3}{8}$ inch rivet.

Because of the impact stress, the ram assembly eventually breaks up after thousands of rivet upsets. The ram assembly 400, shown in FIG. 2, and illustrative of a preferred embodiment of the present invention, has been tested and found to greatly exceed the cycle life of the ram assembly shown in FIG. 1.

The usual mode of failure of the ram assembly shown in FIG. 1 is by cracking of insulator plug 322 lengthwise. Because the fibers of the composite insulator plug must run lengthwise to transmit the compression load, there is very little shear strength under the screw heads shown in FIG. 1. In such event, the insulator plug is not replaceable, leaving only the tubular-shaped ram shaft 324 reuseable.

Turning now in more detail to the preferred embodiment of ram assembly 400 shown in FIG. 2, it will be seen that ram assembly 400 includes three parts: viz., a conductive driving plate 421 of copper, more specifically, full hard rolled copper; a second part, comprising insulator plug 423, which is a composite of unidirectional glass fibers in an epoxy matrix, the fibers being oriented parallel to the central axis 500 of ram assembly 400, and, the third part comprising tubular-shaped ram shaft 424, having a flange-like end portion 430. The three parts of ram assembly 400 shown in FIG. 2 are bonded together by an adhesive layer 451 disposed between abutting major surface areas of conductive driving plate 421 and insulator plugs 423, and adhesive layer 461 disposed between the abutting major surface areas of insulator plug 423 and flange-like end portion 430 of tubular-shaped ram shaft 424. The ram assembly 400 no longer requires a part such as the aluminum driving disc 322 shown in ram assembly 300 due to the elimination of screws.

The reduced number of interfaces in the ram assembly 400 when compared to the ram assembly 300 provides superior load distribution since there are fewer interfaces to reflect shock waves. Also, shear stress in insulator plug 423 is greatly reduced compared to shear stress of insulator plug 323 since there are no counterbores or screws. The aforementioned glass fiber orientation and the epoxy matrix forming insulator plug 423 provides for strong compressive strength without consequent damage and fracture of insulator plug 423. Bond lines 451 and 461 utilize an adhesive, such as a thermo-set epoxy manufactured by 3-M Company of Minneapolis, Minn., denoted as film adhesive AS-126. Prior to assembly of the three parts of ram assembly 400, the abutting surfaces to be treated with the adhesive are applied a coating of liquid adhesive primer, such as EC2320A manufactured by 3-M Company of Minneapolis, Minn.

I claim:

1. In combination, for use in an electromagnetic work tool:

a ram assembly comprising a ram shaft, conductive driving plate, and insulator plug fastened together to provide an integral structure;

said ram shaft having a flange-like end portion providing a flat major surface area;

said insulator plug comprising a cylinder-like composite structure of glass fibers in an epoxy matrix, said glass fibers disposed in parallel relationship with said central axis of said ram shaft;

said cylinder-like composite structure having two major surface areas, a bond line between a first of said two major surface areas and said conductive driving plate, and a further bond line between a second of said two major surface areas and said flat major surface area.

* * * * *